US005148995A

United States Patent [19]

Hurst

[11] Patent Number: 5,148,995

[45] Date of Patent: Sep. 22, 1992

[54] APPARATUS FOR DECOMPOSTING COMPRESSED TABLETS

[76] Inventor: Richard F. Hurst, 1101 River Reach Rd., Fort Lauderdale, Fla. 33315

[21] Appl. No.: 739,349

[22] Filed: Aug. 1, 1991

[51] Int. Cl.[5] ..... B02C 13/06

[52] U.S. Cl. ..... 241/30; 241/169.1; 241/DIG. 27

[58] Field of Search ..... 241/168, 30, 169.1, 241/169.2, 260.1, DIG. 27

[56] References Cited

U.S. PATENT DOCUMENTS

| | | | |
|---|---|---|---|
| D. 235,501 | 6/1975 | Mantelet | 241/169.1 |
| 433,077 | 7/1890 | Giroux | 241/169.1 |
| 762,497 | 6/1904 | Snyder | 241/169.1 |
| 1,535,772 | 4/1925 | Haufler | 241/168 |
| 2,631,786 | 3/1953 | Morgan et al. | 241/168 |
| 2,886,253 | 5/1959 | Skibicki et al. | 241/63 |
| 3,915,393 | 10/1975 | Elkins | 241/168 |
| 5,067,666 | 11/1991 | Sussman | 241/36 |

FOREIGN PATENT DOCUMENTS

| | | | |
|---|---|---|---|
| 2648728 | 12/1990 | France | 241/260.1 |
| 89/05113 | 6/1989 | World Int. Prop. O. | 241/169.1 |

*Primary Examiner*—Mark Rosenbaum
*Assistant Examiner*—John M. Husaar
*Attorney, Agent, or Firm*—John B. Sowell

[57] ABSTRACT

Apparatus for decomposing hard compressed tablets into powder includes a housing having a hopper for receiving the tablets therein and a discharge chute in the housing for discharaging the decomposed powdered tablets directly into a patient's cup. The housing is further provided with a cylindrical aperture therethrough which is adapted to receive an imperforate rotor in the cylindrical aperture. The imperforate rotor is provided with helical blades which protrude from said imperforate rotor means for decomposing said hard compressed tablets by a slicing and cutting action which controls the size of the powder by the height of the slicing blades.

20 Claims, 3 Drawing Sheets

APPARATUS FOR DECOMPOSTING COMPRESSED TABLETS

BACKGROUND OF THE INVENTION

1. Field of the Invention

The present invention relates to a novel apparatus for uniformly decomposing compressed tablets into a uniform size powder form. More particularly, the present invention is directed to a hand held device or apparatus which controllably crushes and shaves tablets in a compressed form using a minimum amount of manual force so as to deposit the decomposed tablet powder directly into a universal patient cup of the type standardized for use in hospitals.

2. Description of the Prior Art

The present invention relates to an apparatus for solving a number of universally recognized problems. It has long been recognized that one of the preferred ways of administering medication is orally in tablet form. Medication in tablet form is the least expensive form in which to manufacture and package medication and is a preferred non-invasive delivery method. Further, compressed tablet form medication is the best form to avoid tampering.

There are several recognized problems associated with administering medication in tablet form. A principal known problem is that a large number of people are subject to gag reflex response which will not permit them to swallow a tablet in solid form. A large number of bedridden patients or patients disposed in a reclined position are also not capable of swallowing tablets in solid form or in granular form. Persons or patients having to use nasalgastrological feeding tubes or other types of feeding tubes require that their medication be presented in a solution or liquid form. Medication has heretofore been taken in liquid form through a straw or in a powdered form when mixed with food. The above problems that exist with human patients also exist in the field of veterinary medicine.

Heretofore, the preferred solution to the abovementioned problems of administering oral medication in tablet form is to grind, abrade (comminute) and compress fracture (crush). Heretofore, devices and apparatus for decomposing tablets in fractured particle form or in granular or in powder form have been classified in U.S. Class 241, Subclasses 168, 169 and 273 with comminution or defracture devices.

Typical of such crushing devices is shown in U.S. Pat. No. 2,892,595 which shows a pair of plastic nesting conical mortar and pestle assemblies. The problem with such crushing devices is similar to the well known pharmacists hard stone-like mortar and pestle which cannot generate the necessary forces to fracture and decompose ultra-hard tablets such as calcium gluconate, etc. Such crushing devices leave particles on both assemblies that are not easily dislodged when it is necessary to transfer the crushed tablet in a glass or receptacle for consumption.

Typical of such grating devices is shown in U.S. Pat. No. 2,804,896 which shows a household food grater or slicer having a hollow spool or cylinder provided with rows of sharp edge grating apertures formed therein. The article of food to be grated is placed in a hopper and a shaped follower is manually pressed down on the top of the food. This type grating device leaves a substantial amount of ungrated food in the hopper, apertures and the hollow spool, thus, cannot be used for comminuting medication in its present form or in a modified form without wasting a portion of the prescribed medication.

U.S. Pat. No. 4,209,136 shows a device for chopping and crushing medicinal tablets which device is adapted from a food chopper. This chopping device will reduce tablets to a granular form by a crushing or chopping action but leaves medication on the crusher foot and in the container when transfer is made to a glass or receptacle when used for consumption.

These and other devices are found in Class 241 which are not suitable for grinding or slicing medication in tablet form to provide a powder of predetermined size quickly dissolvable for use with feeding tubes or to be administered with solid foods with little or no waste involved in either case.

It would be desirable to provide an apparatus for decomposing compressed tablets to a powder in a predetermined size form which does not waste the medication.

SUMMARY OF THE INVENTIONS

It is a primary object of the present invention to provide a novel apparatus for decomposing compressed tablets into predetermined powder size and depositing the powder directly into a universal patient cup for direct use by a patient.

It is another primary object of the present invention to provide a novel apparatus for decomposing compressed tablets into a powder form with a minimum of physical effort and time leaving a minimum of residue within the apparatus.

It is another primary object of the present invention to provide a device for pre-fracturing ultra hard tablets to insure rapid and uniform decomposition into a powder form.

It is another principal object of the present invention to provide a novel device for reducing a plurality of the same or different tablets to a predetermined size powder form.

It is another object of the present invention to provide a novel apparatus for decomposing tablets employing a rotor which slices of shaves the hard tablets with a minimum of effort.

It is another object of the present invention to provide a novel apparatus for decomposing tablets which may be assembled to suit either left handed or right handed persons who operate the device.

It is yet another object of the present to provide a novel apparatus for decomposing tablets which may be destroyed after use or recycled through a controlled environment.

According to these and other objects of the present invention, there is provided a apparatus and method for decomposing hard tablets into a powder form having a predetermined maximum size which includes loading the tablets to be reduced to powder in a hopper of a housing and providing an imperforate rotor in the housing having protruding helical shaped cutting ribs extending therefrom. The tablets are pressed against the rotor and the helical cutting ribs while the rotor is rotated to simultaneously crush and shave powder particles from the tablets which are restrained in the hopper of the housing until crushed and shaved to the predetermined size defined by the height of the helical shaped cutting ribs.

DESCRIPTION OF THE PREFERRED EMBODIMENTS

Figure 1:
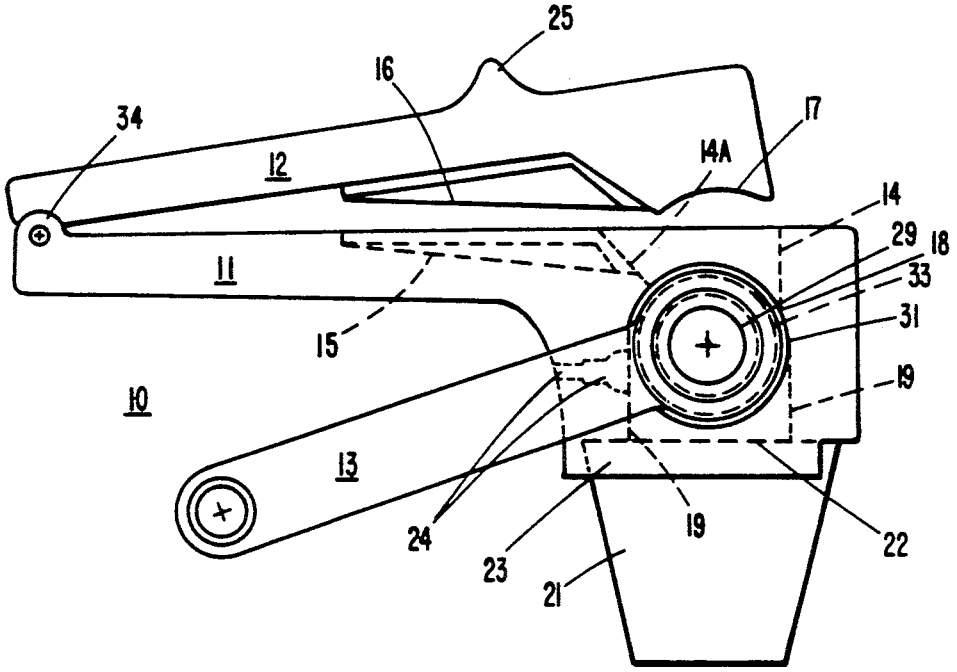
FIG. 1 is a side view in elevation of a preferred embodiment tablet decomposing apparatus according to the present invention.

Refer now to FIG. 1 showing a side view in elevation of a preferred embodiment tablet decomposing apparatus 10 which comprises a housing assembly 11, a pressor foot assembly 12 and a rotor and crank assembly 13 mounted in the housing 11. The housing 11 is provided with a tapered feed hopper 14, 14A in which tablets may be placed directly or pre-crushed (pre-fractured) by placing the tablet in the pre-fracturing recess 15 and crushing and fracturing the tablets placed in the pre-fracturing recess 15 by engaging them with the pre-fracturing blade 16 mounted on the pressor foot assembly 12. Blade 16 may be made from a piece of sharp metal or integrally molded as a blade as part of the assembly 12. The pressor foot 17 is provided with a partial cylindrical shape which is adapted to match and fit the tops of the slicing ribs (not shown) which rotate in the cylindrical plane 18. As will be explained in more detail hereinafter, tablets caught between the pressor foot 17 and the plane of revolution 18 of the slicing ribs will be sliced and pulverized while being held by the forward portion of the feed hopper 14. Discharge chute 19 is shown having the same width as the diameter of the cylindrical plane 18 of the slicing ribs and is larger than the opening of the tapered feed hopper 14 at its engagement point with the slicing rotor. A patient's cup 21 is shown held in place against the bottom surface 22 of the housing 11. The patient's cup 21 is a standard plastic cup having different types of calibrations or graduations thereon. Normally the cup is provided with graduations up to one fluid ounce, graduations up to eight drams, graduations up to two tablespoons, graduations up to 30 cubic centimeters and graduations up to 30 milliliters. Such cups are known as universal patients' cups and are used throughout the world. Since the cup 21 is standard and of uniform size throughout the world, it readily fits into an annular tapered ring provided as an extension on the housing assembly 11. In the process of decomposing tablets, the size of the powder can be controlled by controlling the height of the slicing ribs as will be explained hereinafter. Since a very fine powder traps below the top of the slicing rib, a cleaning brush (not shown) may be inserted in the brush recess 24 and forms an effective means for dislodging powder. A thumb rest 25 is provided on pressor foot assembly 12 and is positioned therealong to permit a person holding the decomposing apparatus 10 in one hand to apply sufficient pressure on the pre-fracturing blade 16 and pressor foot 17 to completely decompose tablets in the decomposing apparatus.

Figure 2:
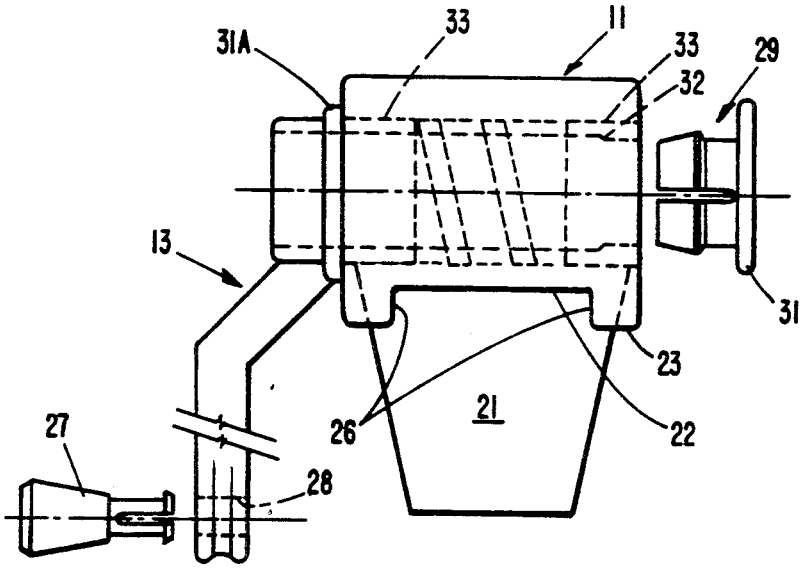
FIG. 2 is a front view of the apparatus shown in FIG. 1.

Refer now to FIG. 2 showing a front view of the apparatus 10 shown in FIG. 1. The patient's cup 21 is shown mounted in the annular tapered ring 23 which has an opening 26 which permits the top of the patient's cup 31 to be squeezed at the top and slid into place tightly against bottom surface 22. The flexing of cup 21 tightly holds the cup 21 against the surface 22 when released.

The crank and rotor assembly 13 is shown having a rotatable knob 27 which snaps through recess 28 during assembly. Similarly a end cap 29 having an anti-friction flange 31 snaps into recess 32 and urges the opposite anti-friction flange 31A into engagement with the side of the housing 11. Housing 11 is provided with cylindrical bearing recesses 33 which are adapted to receive the bearings on the rotor in a manner which provides a seal and yet provides rotatable movement as will be explained hereinafter.

Figure 3:
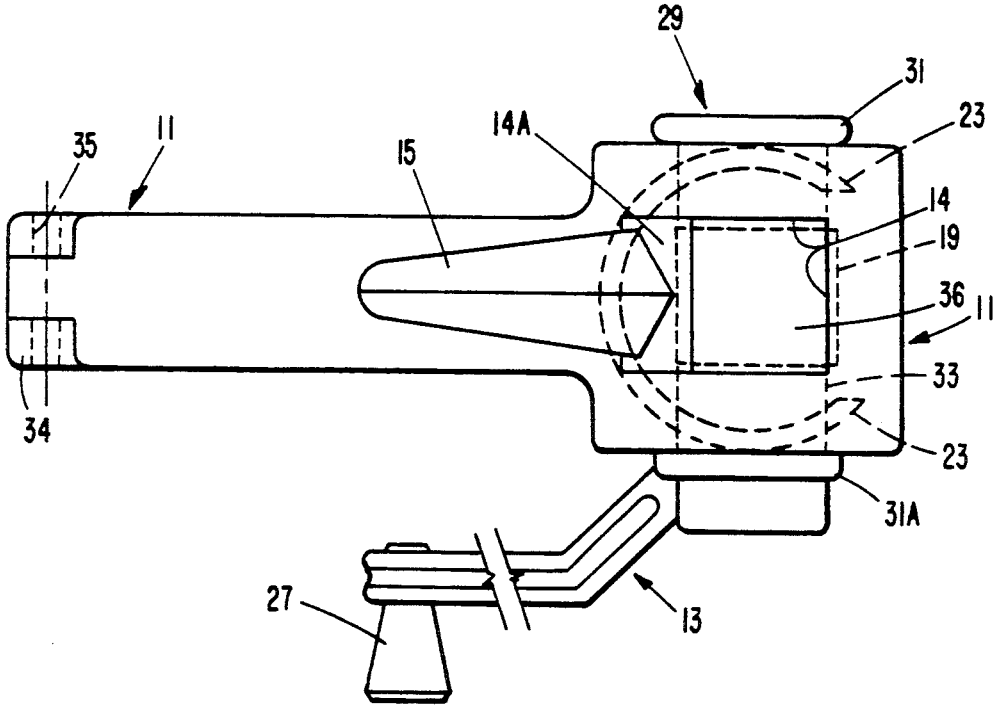
FIG. 3 is a partial top view showing the rotor and crank mounted in the housing of FIGS. 1 and 2 and showing a pre-fracturing recessed trough in the handle of the housing.

Refer now to FIG. 3 showing a top view of the housing assembly 11 with a crank and rotor assembly 13 mounted therein and the pressor foot assembly 12 removed. The pre-fracturing recess 15 is shown tapered and becoming progressively deeper as it approaches the tapered feed hopper 14 having a tapered side wall 14A. A hinge extension 34 is provided on the handle of the housing assembly 11 and adapted to receive a pin in the recess 35 to pivotally mount the pressor foot assembly 12 thereon. When using modern injection molded techniques, it is possible to eliminate the hinge extension 34 and substitute a flexible and narrow molded sheet of plastic for the hinge 34 and pin 35. Before referring to details of the crank and rotor assembly 13 it will be understood that the shaving means 36 which completely fill the hopper 14 comprise raised ribs or slicing means on an imperforate cylinder which completely fills the hopper from wall to wall.

Figure 4:
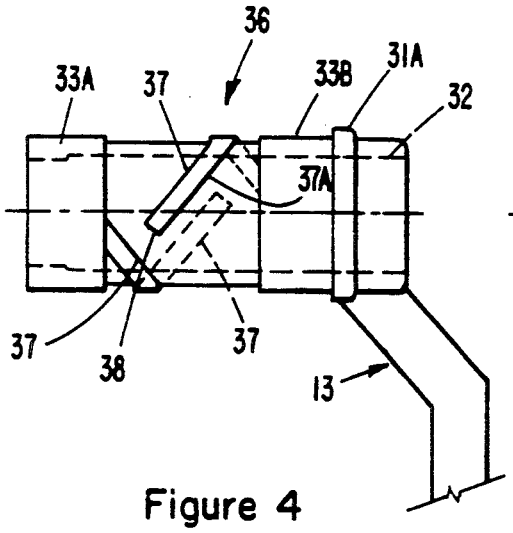
FIG. 4 is an enlarged view of a rotor showing dual anticlog slicing ribs according to the preferred embodiment of the present invention.

Refer now to FIG. 4 showing an enlarged view of the shaving means 36 on a crank and rotor assembly 13. Cylindrical bearings 33A and 33B fit snugly but rotatably in the bearing recesses 33 shown in FIGS. 2 and 3. Shaving means 36 comprise a pair of raised ribs 37 that are discontinuous. The forward edges of ribs 37 are indicated at the lead line of the numerals 37 and are sharp protruding edges which cut or shave the bottom of a tablet which is placed in the tapered feed hopper 14. As will be explained hereinafter, the trailing edges 37A may be tapered to prevent any possible buildup of powder from the tablets. When the rotor is rotated clockwise in the direction of the arrow, the leading or cutting edge 37 will cause powder from the tablet to collect below the top of the rib and shift to the right to the end point 38. As the powder leaves the end point 38 of the rib 37, it soon engages the next leading edge 37 of the companion rib 37 and is then shifted to the right until it either slips by the end 38 or is deposited in the discharge chute 19. It will be understood that the crank and rotor assembly 13 may be injection molded and is preferably made as a hollow cylindrical form in which the shaving means 36 is an imperforate part of the cylindrical. Thus any powder that is sliced from a tablet is shifted to the left and back to the right and to the left and back to the right until it is discharged in the discharge chute 19 as is clearly shown in FIGS. 1 through 3.

Figure 5:
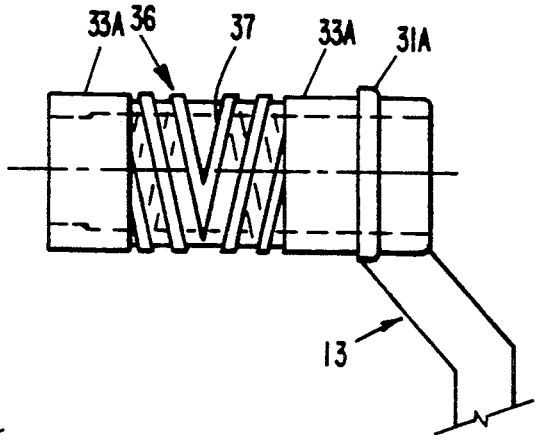
FIG. 5 is an enlarge view showing another rotor having dual cutting ribs which have a tendency to clog.

Refer now to FIG. 5 showing another form of dual rib shaving means. The leading edges of this dual spiral rib configuration tend to trap powder in the crotch of the V shown in the center of the shaving means 36. However, the nature of this device tends to move the powder shaved from the tablets towards the center of the discharge chute 19 and has been found to be a Very effective shaving means for most tablets. When used in conjunction with the cleaning brushes and combs to be described hereinafter, this dual rib configuration is extremely effective and when used in conjunction with tapered trailing edges of the ribs little or no residue is accumulated even without the cleaning brushes. Rotors made from hard glass-like finish plastic do not tend to clog.

Figure 6:
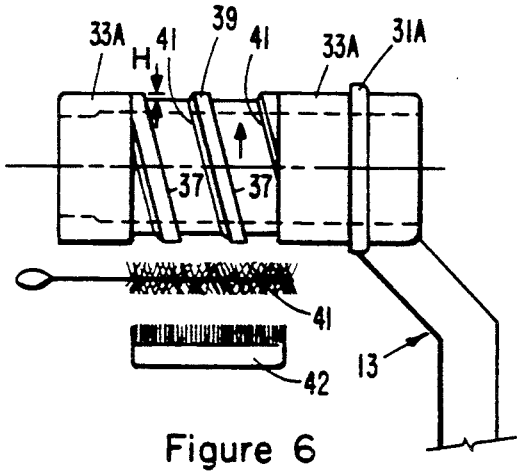
FIG. 6 is an enlarged view of a rotor having a continuous spiral cutting rib and a cleaning brush of the type which mounts in the housing juxtaposed the slicing ribs.

Refer now to FIG. 6 showing a singular helical rib 39 having leading cutting edges 37 and tapered trailing edges 41. While this single helical rib is extremely effective in slicing tablets by removing portions at no more than the height H of the rib 39, it tends to move the powder to the right and traps powder against the side of the rib 39 which engages the right most bearing 33A, however, deposits which form in this V shaped cavity can be easily removed by a resilient brush 41 which cleans the cavities below the tops of the ribs when properly inserted in the brush recess 24 shown in FIG. 1. It will be understood that the brush 41 may be replaced with a resilient comb 42 or resilient comb shaped brush 42 as the case may be.

Figure 7:
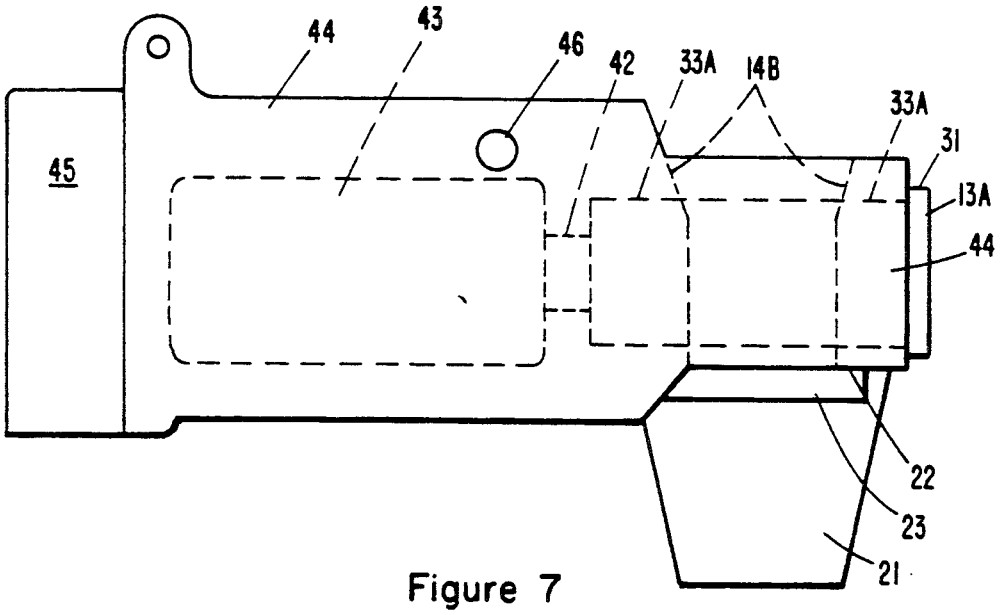
FIG. 7 is a front view and partial section of the motorized version of the apparatus shown in FIGS. 1 through 6.

Refer now to FIG. 7 showing a front view of a motorized version of the decomposing apparatus shown in FIGS. 1 to 6. The major modification required for simplification or a motorized version is to change the axial direction of the shaving means 36 by 90° so that the shaft 42 of the motor 43 in housing 44 can directly couple to the rotor means 13A,36 thus replacing the need for a crank arm. The motor 43 is preferably driven by a rechargeable battery pack 45. In the preferred embodiment of the motorized version an actuation switch 46 is provided in the thumb area and completely clear of the pressor foot assembly 12A (not shown). It will be appreciated that the rotor assembly 13A may be provided with a cap having an anti-friction flange 31 which is adapted to hold the rotor assembly in place against the housing 44 and may be inserted in the housing assembly from the flange 31 end to engage a spline or recess in the shaft 42. The side walls 14B of the hopper are shown having a taper, thus, the pressor foot (not shown) is provided with a similar taper and cylindrical shape so as to engage firmly against the slicing or cutting ribs of the rotor.

Figure 8:
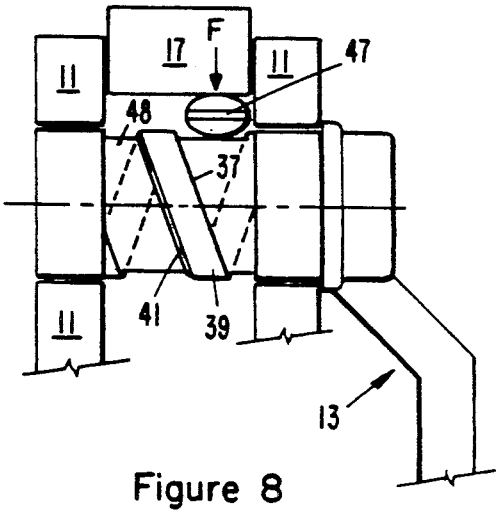
FIG. 8 is an enlarge schematic view of a continuous spiral slicing rib prior to slicing and cutting a tablet which is captured between the presser foot and one of the rotors of the apparatus from a crushing action.

Refer now to FIG. 8 showing an enlarge schematic view of a continuous spiral slicing rib 39 of a rotor assembly 13 mounted in a housing assembly 11 and having a curved pressor foot 17 engaging a tablet 47 between the pressor foot and the rotor surface 48. The force of the pressor foot 17 is seldom great enough to permit the leading edge 37 of the rib 39 to make a slice from the tablet 47 which is as thick as the height H of the rib 39. This is to say that the slicing action of the leading edge 37 actually shaves portions from the tablet 47 which never exceed the height H. The tablet 47 is urged by the inclined or helical direction of the rib 39 into engagement with a side of the housing 11 as shown. As portions of the tablet 47 are shaved or removed, the force of the pressor foot 17 will eventually cause the tablet to be crushed or fractured which further enhances the powdering and decomposition procedure even if the tablet has not been pre-fractured using the prefracturing means 15, 16 described hereinbefore. It will be appreciated that the diagonal or helical direction of the cutting edge 37 enhances the shaving action and reduces the force required to rotate the rotor, however, various forms of ribs have been considered. A horizontal rib or protrusion provided on the rotor 13 is not as effective as a helical shape. If the ribs are placed too close together then the tablet 47 does not have adequate space to drop between the helical ribs and perform the desirable shaving action. Other forms and shapes of ribs are operable but are not as effective as the helical shape described herein as the preferred embodiment of the present invention.

Having explained an anti-clogging or self cleaning dual rib configuration and several modifications thereof, it will be appreciated that the ribs are in fact raised cutting blades or slicing blades as distinguished from recesses which could easily become clogged. The helical or spiral shape only enhances the shaving action.

The decomposing apparatus described in detail hereinbefore is preferably made of the three components or assemblies 11, 12 and 13 described hereinbefore and are made by injection molding so that the apparatus may be sold cheap enough to permit it to be used as a throw away apparatus after use. In the preferred mode of operation, a decomposing apparatus is assigned to a patient in a hospital or in a home or other facility. Once the patient is dismissed, the apparatus may be given to the patient. It is up to the administering and prescribing doctors to prevent intermixing tablets in chemical form which could be harmful. In such cases it would be desirable to use a different color apparatus for chemicals which are dangerous so as to visually warn the person or staff administering the medication that the decomposing apparatus is only used for certain drugs and not for the general run of drugs which could be intermixed.

A feature of the present invention is that it may be made for right handed persons or left handed persons by reversing the crank and rotor assembly in the standard housing. This also requires a reverse helical shape so that the leading edge cuts in the direction in which the left handed or right handed model would ordinarily be turned. Further, the motorized version shown in FIG. 7 has been made so that the rotor-shaving means is completely removable as a unit and may be cleaned and reused by standard cleaning and/or sterilization procedures. It will be appreciated that the universally standard patient's cup 21 fits so tightly against the bottom surface 22 that n spillage will occur even when the apparatus is accidentally dropped after decomposing a tablet or tablets which are now contained in the patient's cup 21. In the preferred embodiment of the present invention it was found that the height H of the slicing rib 39 when made approximately 1/30th of an inch produced a powder so fine that it met all presently known requirements for all different types of patients and still permitted the apparatus to decompose several tablets in less than one minute, thus, the decomposing apparatus is known to perform an extremely desirable function as well as paying for itself in the saving of time of skilled personnel.

While the novel decomposing apparatus was designed to reduce compressed tablets to a powder of a predetermined size it has been used to decompose peppercorns and coffee beans, thus, has a desirable secondary use for powdering hard and semi-hard condiments and food items. Powdered custom blend coffee may be deposited directly into a filter paper holder of the type used for a single cup of coffee made in a microwave oven or a larger filter of the type used in coffee machines. Thus, the preamble of the claims is not intended to restrict the claims to the preferred mode of use.

What is claimed is:

1. Apparatus for decomposing compressed tablets comprising:

a housing:

a hopper in said housing for receiving tablets therein, discharge recovery chute means in said housing for receiving decomposed tablets in powder form, a cylindrical aperture through said housing positioned between said hopper and said discharge chute means, smooth cylindrical imperforate rotor means mounted in said cylindrical aperture in said housing, blade means protruding from said cylindrical imperforate rotor means for decomposing compressed tablets employing a slicing or cutting action, said blade means being spaced apart to permit said tablets to engage said rotor means, rotor shaped pressor foot means for pressing tablets into said hopper against said rotor means, and drive means for rotating said imperforate rotor means and for completely decomposing said tablets placed in said hopper into a fine loose powder which releases from said rotor means.

2. Apparatus as set forth in claim 1 which further includes cup retaining means on said housing for suspending a patient's cup below said discharge chute means.

3. Apparatus as set forth in claim 1 wherein said protruding blade means comprises a raised rib having a vertical leading cutting edge.

4. Apparatus as set forth in claim 3 wherein said raised rib is provided with a tapered trailing edge.

5. Apparatus as set forth in claim 3 wherein said raised rib is formed as a segment of a helical spiral on said rotor means.

6. Apparatus as set forth in claim 3 wherein said protruding raised helical rib comprises a single spiral rib terminating at the sides of said hopper.

7. Apparatus as set forth in claim 4 wherein said formed raised rib on said rotor means comprises a plurality of helically formed raised ribs having at least one pair of ribs with helical spirals wound in opposite directions.

8. Apparatus as set forth in claim 4 wherein said protruding raised helical rib comprises a pair of discontinuous spiral shaped ribs wound in opposite helical directions, each said rib having one edge terminating at opposite sides of said hopper.

9. Apparatus as set forth in claim 5 wherein the top of said helical rib rotatably engages a portion of said cylindrical aperture in said housing so that powder decomposed from said tablets is forced to pass from said hopper to said discharge chute means in the space between the rotor and the top of said raised helical rib, whereby, the size of the powder cut from said tablets can never exceed the height of said raised rib.

10. Apparatus as set forth in claim 1 wherein said imperforate rotor means comprises a pair of end bearings journaled in said housing and said rotor means further comprises removable retaining cap means mounted in said rotor means on the end opposite said drive means for maintaining said rotor in said housing means and for permitting said rotor means to be mounted in said cylindrical aperture in a left hand or right hand drive mode configuration.

11. A method of decomposing hard tablets into powder form of a predetermined maximum size, comprising the steps of:

loading tablets to be completely reduced to powder in a hopper of a housing, providing an imperforate rotor in said housing having protruding helical shaped cutting ribs extending therefrom, pressing said tablets to be reduced to powder against said rotor and said helical shaped cutting ribs, rotating said rotor to simultaneously crush and shave powder particles from said tablet, and applying force on the crushed and powdered particles in said hopper of said housing until they are all reduced to a size less than the height of said helical shaped cutting ribs, and forcing all of said particles out of said hopper and into a discharge recovery chute.

12. The method as set forth in claim 11 which further includes attaching a patient's cup to said housing, and collecting substantially all said crushed and powdered particles in a predetermined powder size form in said patient's cup ready for use.

13. The method as set forth in claim 12 which further includes the step of crushing said tablets in a prefracturing recessed through means connected to said hopper in said housing, and sliding said crushed tablets in said recessed trough means to said hopper of said housing prior to decomposing said tablets to powder particles.

14. Apparatus for decomposing compressed tablets, comprising:

a housing, a hopper in said housing for receiving tablets therein, discharge chute means in said housing for receiving decomposed tablets in powder form, a cylindrical aperture through said housing positioned between said hopper and said discharge chute means, imperforate rotor means mounted in said cylindrical aperture in said housing, blade means protruding from said imperforate rotor means for decomposing compressed tablets employing a slicing or cutting action, means for pressing tablets into said hopper against said rotor means, drive means for rotating said imperforate rotor means to completely decompose said tablets placed in said hopper, and cup retaining means integral with said housing for engaging a patient's cup against said housing and said discharge chute means.

15. Apparatus as set forth in claim 14 which further includes a tapered hopper in said housing for receiving tablets to be decomposed and tapered pressor means adapted to conform to said hopper and to said imperforate rotor means, whereby tablets compressed between said rotor means and said pressor means are completely decomposed into a fine loose powder which falls free into said patients cup without clogging or spilling.

16. Apparatus as set forth in claim 14 wherein said blade means comprises a pair of raised ribs separated from each other on said rotor, each of said raised ribs having one end terminating at opposite sides of the hopper, and the free ends of said raised ribs terminating short of the other opposite sides of said hopper whereby tablets being decomposed in said hopper cannot be compressed axially against a side of the hopper.

17. Apparatus as set forth in claim 14 wherein said cup retaining means comprises a tapered annular ring adapted to engage a to portion of a patient's cup and to bias said patient's cup into engagement with a bottom surface of said housing opposite said discharge chute.

18. Apparatus as set forth in claim 14 which further includes resilient rotor cleaning means mounted in an aperture in said housing for dislodging powder on said rotor means.

19. Apparatus as set forth in claim 14 which further includes pre-fracturing means on said tapered pressor means and handle means comprising blade means cooperating with recessed trough means.

20. Apparatus as set forth in claim 19 wherein said trough means are recessed in a trough in said handle means and said blade means are mounted on said handle means to substantially fill said trough means, and said recessed trough means being opened into said hopper means so that fractured tablets may be emptied directly into said hopper means to be decomposed by said rotor means.

* * * * *